United States Patent [19]

Schädlich

[11] Patent Number: 4,498,254

[45] Date of Patent: Feb. 12, 1985

[54] SPRAYING APPARATUS FOR LAUNDRY MANGLES

[75] Inventor: Gotthard Schädlich, Aue, German Democratic Rep.

[73] Assignee: VEB Kombinat Textima, Karl Marx Stadt, German Democratic Rep.

[21] Appl. No.: 375,856

[22] Filed: May 7, 1982

[30] Foreign Application Priority Data

Sep. 1, 1981 [DD] German Democratic Rep. ... 232916

[51] Int. Cl.[3] ..... D06F 65/10

[52] U.S. Cl. ..... 38/14; 68/5 D; 239/566; 118/70; 118/325; 38/56

[58] Field of Search ..... 38/3, 14, 52–57, 38/77.1, 77.5, 44; 118/325, 70; 68/5 D, 5 E; 100/73, 74; 239/566, 567, 106; 165/89, 90; 261/DIG. 76; 19/66 R

[56] References Cited

U.S. PATENT DOCUMENTS

| | | | |
|---|---|---|---|
| 1,320,907 | 11/1919 | Parlser | 239/567 X |
| 1,537,916 | 5/1925 | Black | 38/77.1 X |
| 1,649,337 | 11/1927 | Brewer | 38/14 |
| 1,769,397 | 7/1930 | Strickland | 118/325 X |
| 2,146,809 | 2/1939 | Flint | 118/325 X |
| 2,883,511 | 4/1959 | Gooldy | 239/566 X |
| 3,011,266 | 12/1961 | Heissner | 68/5 E X |
| 3,736,902 | 6/1973 | Glanzer | 118/325 X |
| 3,799,401 | 3/1974 | Braun et al. | 118/70 |
| 4,019,225 | 4/1977 | Nayfa | 19/66 R |

FOREIGN PATENT DOCUMENTS 7007007 2/1970 German Democratic Rep. .

*Primary Examiner*—Werner H. Schroeder
*Assistant Examiner*—Andrew M. Falik
*Attorney, Agent, or Firm*—Jordan and Hamburg

[57] ABSTRACT

An apparatus for decreasing the friction of pieces of wet or damp laundry pressing surfaces of one or more steam trough mangles applies a liquid lubricating agent such as silicone oil or silicone oil emulsions. The lubricating agent is applied in atomized, pressurized form uniformly over the entire width of the pressing surface of one or more steam trough mangles with the droplets of the atomized, pressurized lubricating agent being applied at the same time to the entire width of the pressing surface. The lubricating agent which has been atomized in at least one atomizer by a gaseous medium under pressure is transportable by such a gaseous medium through at least one conduit and is delivered to the pressing surface of the steam trough mangle through a pipe which extends substantially horizontally over the entire width of the pressing surface and which has openings extending over substantially the entire length of the pipe.

19 Claims, 3 Drawing Figures

SPRAYING APPARATUS FOR LAUNDRY MANGLES

BACKGROUND OF THE INVENTION AND PRIOR ART STATEMENT

This invention relates to an apparatus for the improvement of the sliding quality of textile surface configurations, especially of pieces of laundry, on pressing surfaces, preferably on the pressing surface of a steam trough mangle, in which a liquid lubricating agent, such as silicone oil or emulsions thereof, is especially used.

It is essential that during utilization the troughs of the steam trough mangles be constantly coated with a film of lubricating agent, such as, for instance, a wax coating. Such wax coating levels fine surface irregularities, while reducing, at the same time, the torque required to drive the mangle cylinder. In addition, the danger of a rolling up of the intake edge or the formation of creases in the laundry in the mangle by reason of excess friction between the trough surface and the laundry in the mangle, is limited as much as possible. Federal Republic of Germany Utility Model 7 007 007 (8d, 20/24) presents a solution by which a spreading wax in powder form is poured onto a wax-permeable cloth. This cloth is then folded, passing in this form through the steam trough mangle. The wax melts due to the temperature present on the pressing surface, being thus delivered to the pressing surface through the cloth. Herein, however, the wax is irregularly delivered to the pressing surface so that a larger quantity of wax is deposited on the pressing area near the trough entrance than on the pressing area near the trough exit. Especially when multiple trough mangles are involved, the amount of wax deposited in subsequent troughs is less so that, especially in the last troughs where the laundry is already relatively dry, which results in relatively great friction between the laundry in the mangle and the pressing surface, the smallest amount of wax is present on the pressing surface. In addition, only by expending considerable time and expenses will it be possible to achieve a uniform distribution of the wax over the width of the trough.

Another disadvantage can also be seen in the fact that the wax present in the trough evaporates, which is suctioned away by the ventilator associated with the mangle cylinder. Herein, a portion of the wax already condensed in the textile wrapping, necessarily leads to a reduction in permeability of the textile wrapping and, thereby, to a reduction in the suction quantity, with the unavoidable result of a reduction in drying performance of the steam trough mangle.

In addition, another disadvantage can be seen in the fact that the wax cloth per se is a relatively stable form which does not, in every case, rest smoothly on the transport belts. Thus the finger guard positioned at the entrance of the mangle is very often activated, resulting in a switching-off of the steam trough mangle drive. On the other hand, a specific time is required for the waxing cloth to pass through the steam trough mangle. Especially in mangle lines, meaning when additional machines are associated with the steam trough mangle, such as, for instance, a feeder machine, the passage time of the waxing cloth is increased. Such passage times represent, at the same time, down times, during which no laundry can be dried or smoothed. Although by means of a once-only waxing step, such times may be kept relatively short, they will, however, within a certain period of time, accrue to relatively high down times. Not considered herein are the times required to adjust the feeder machine to what is called small-item feed.

Another disadvantage can also be seen in the fact that a certain time is required for preparing the waxing cloth. Furthermore, it is very inconvenient that the personnel servicing the steam trough mangle are required to remove the still hot waxing cloth at the exit of the mangle. Since the waxing cloth cannot be transported through the longitudinal folding machine—because wax particles from the still hot waxing cloth would deposit on the conveyor belts with detrimental effects to the whole folding process—it should be removed at the mangle exit.

It is the object of the invention to provide an apparatus to improve the lubricating quality, especially of laundry pieces, on pressing surfaces, in which the lubricating agent can be uniformly applied to the pressing surface, the down times on introduction of the lubricating agent are reduced and, in addition, inconvenience to the servicing operator is removed.

SUMMARY OF THE INVENTION

The invention has the object of developing the apparatus for the improvement of the sliding quality, especially of laundry pieces, on pressing areas, in such a way that the lubricating agent is as finely divided as possible and can be fed approximately at the same time over the whole width of the steam trough mangle at a pressure above atmospheric pressure.

The solution of this problem is set forth in the claims.

The solution provided by this invention, in essence, operates as follows:

A lubricating agent that runs from a supply vessel by way of a conduit into an atomizer is atomized by air flowing in through a supply conduit into the atomizer in such a way that a lubricating agent mist of very fine droplets is formed. This lubricating agent mist flows through a supply conduit into a pipe and, through the openings in that pipe, onto the wrapping of individual mangle cylinders. The lubricating agent mist adheres to the surface of the wrapping through the effect of the underpressure existing at the interior of the cylinder. Through a rotational movement of the mangle cylinder, the lubricant is brought to the pressing surface of the mangle troughs which are coated by the same. This results in an improvement of the sliding capacity of the laundry pieces to be dried and smoothed on the pressing surface of the mangle troughs.

Lubricating agent droplets that may precipitate in the pipe collect at the lower portion of the circular section of the pipe and run, as a result of the oblique arrangement of the pipe, from the pipe into the supply conduit. By the formation of this supply conduit which, shortly before branching, takes the form of an arc which, when viewed in the vertical direction, is higher at the uppermost point than at the end of the pipe, the lubricating agent, at the branching, runs into the reflux line and collects in the same. Through opening of the blocking mechanism, the lubricating agent flows back into the supply vessel.

Pressurized air is advantageously used to produce the lubricating agent mist, which can be taken from the compressed air net. It is, however, also possible to use the exhaust air of the pneumatic cylinders which is generated on lowering of the mangle cylinder into the mangle troughs, or to use steam. Herein, the measured amount of the lubricating agent mist that is fed to the pipe by the atomizer is apportioned in such a way that it is substantially smaller than the quantity of air sucked away from the individual mangle cylinders. Preferably, the ratio between the suctioned off output of a suctioning ventilator that has not been illustrated that acts on the mangle cylinder and the amount of lubricating agent mist coming out of the pipe that strikes the mangle cylinder is larger than 10:1.

Since the depositing of lubricating agent mist needs only to be carried out at certain time intervals and has to be measured, the apparatus of the present invention can be controlled in terms of time, for example shortly before placing laundry pieces to be dried and smoothed into the steam trough mangle, i.e. on a lowering of the mangle cylinder into the mangle trough.

If an improvement of the sliding quality should become necessary while operating the mangle, then this operation can be carried out at a time when no pieces of laundry run through the mangle.

The apparatus of the present invention can be used with a single trough mangle as also with multiple trough mangles. Thus, in a single trough mangle, the pipe is placed at the entrance of the mangle and, when a two-trough mangle is involved, preferably between the two mangle cylinders. In four-trough mangles, the pipes are arranged between the first and second and between the third and fourth mangle cylinders. Herein, preferably, one atomizer and one supply vessel are arranged at a central position in the four-trough mangle. Within the supply conduit, i.e. in the region between the atomizer and the arc, a branching is arranged in such a way that each pipe can be provided with lubricating agent mist. Preferably, a blocking mechanism, that is equally centrally arranged and is controllably activated, is provided in each conduit providing access to the pipes.

However, the possibility also exists of arranging a mist generator in front of each pipe.

The number, position, and size of the openings inside the pipe for a row of openings depend on the pressure conditions existing inside the pipe. Herein, the openings are arranged in such a way that the lubricating agent mist exiting from the openings will predominantly strike the region of the pressing surface on the mangle cylinders.

BRIEF DESCRIPTION OF THE DRAWINGS

The invention will now be described in more detail by an example of an embodiment. In the pertinent drawing.

DETAILED DESCRIPTION OF PREFERRED EMBODIMENTS

Figure 1:
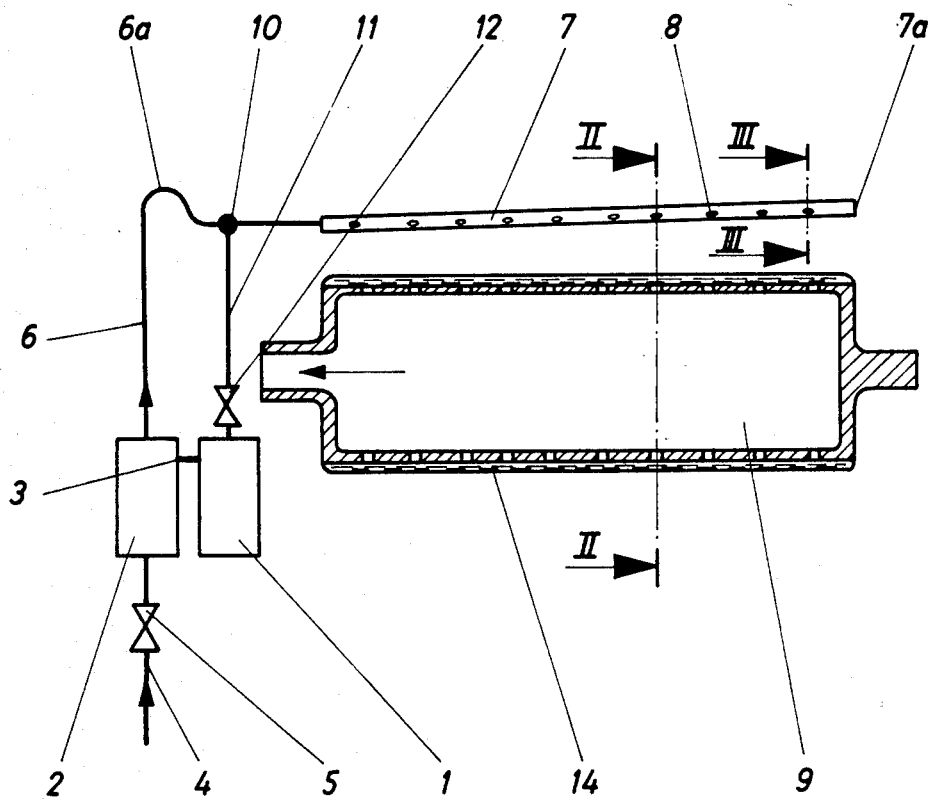
FIG. 1 is a schematic representation of the above apparatus.

As can be seen in FIG. 1, the apparatus for the improvement of the lubricating quality of textile surface configurations, especially laundry items on pressing surfaces, is provided—infra, this apparatus will be explained by the example of a steam trough mangle—with a supply vessel 1 containing the liquid sliding agent, for instance silicone oil or a silicone oil emulsion. An atomizer 2 is further associated with the supply vessel 1, which vessel is in contact with the atomizer 2 through a connecting conduit 3. A supply conduit 4 terminates in the atomizer 2, a blocking mechanism 5, preferably a valve, being arranged in conduit 4. A supply conduit 6 leads from the atomizer 2 to a pipe 7. Pipe 7 is formed as a distributor pipe, being provided with corresponding openings 8, such as borings, slots, nozzles or other openings. Furthermore, pipe 7 is arranged horizontally at an acute angle in relation to the central axis of mangle cylinder 9, i.e. pipe 7 rises slightly starting from branching 10 towards the pipe end *7a*. In the solution proposed by the present invention, supply conduit 6 has been formed in such a way that it has the shape of an arc just before its transition to pipe 7, in which this arc *6a*, viewed in the vertical direction, lies higher than the pipe end *7a*. The branching 10 to the reflux line 11 is located at the lowest point of pipe 7. This reflux line 11 opens into the supply vessel 1, in which a valve 12 is provided inside reflux line 11.

Figure 2:
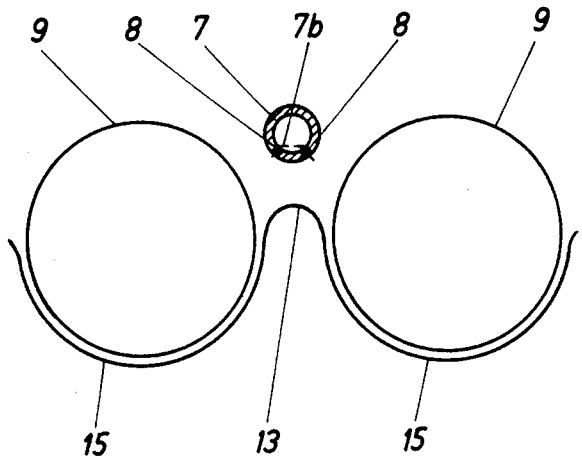
FIG. 2 is a schematic representation along section II—II in FIG. 1.

As can be viewed in FIG. 2, pipe 7 is located between two adjacent mangle cylinders 9, i.e. above the trough bridge 13. Herein, openings 8 in tube 7 are arranged in such a way that they are directed onto the mangle cylinders 9 and open into pipe 7 above the lowest point of the internal cross-sections of the pipe. The remaining lower circular section *7b* forms a reflux channel for sliding agents that may settle alongside the inner wall of the pipe.

The supply vessel 1, atomizer 2 and blocking mechanisms 5 and 12 are preferably arranged at a central position of the trough mangle. In addition, actuation of the blocking mechanisms 5 and 12 can be controlled in such a way that, when blocking mechanism 5 is opened, valve 12 will be closed or, if blocking mechanism 12 is opened, the blocking mechanism 5 will be closed.

The apparatus operates as follows:

The lubricating agent that runs from the supply vessel 1 into the atomizer 2 through conduit 3 is atomized by the air flowing from the supply conduit 4 into the atomizer 2 in such a way that a lubricating agent mist of very fine droplets is formed. This lubricating agent mist flows into pipe 7 through supply conduit 6 and, through openings 8 inside pipe 7, onto the wrapping 14 of mangle cylinder 9. The lubricating agent mist adheres to the surface of wrapping 14, aided by the underpressure present in the interior of mangle cylinder 9. Through a rotating movement of the mangle cylinders 9, the lubricant is brought to the pressing surface of mangle troughs 15 which are then lubricated. This results in an improvement of the sliding capacity of the laundry piece to be dried and smoothed on the pressing surface of the mangle troughs 15.

Figure 3:
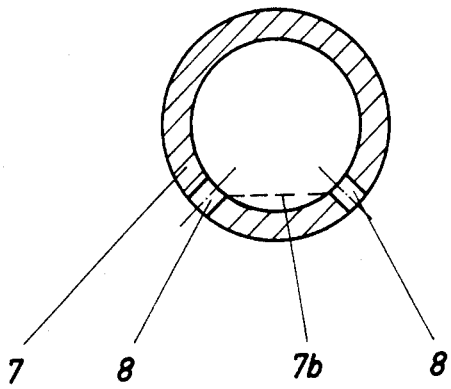
FIG. 3 is a section along III—III in FIG. 1.

Lubricating agent droplets which may precipitate in pipe 7 collect at the lower part of the circular section *7b* (see FIG. 3) of pipe 7 and run from pipe 7 into the supply conduit 6 by reason of the oblique arrangement of pipe 7. Through the formation of supply conduit 6 which shortly before branching 10 has the form of an arc *6a*, the highest point of which—viewed in the vertical direction—lies higher than the pipe end *7a* of pipe 7, the lubricating agent flows into the reflux line 11 at the branching 10 and collects in the same.

By opening blocking mechanism 12, this lubricating agent runs back into the supply vessel 1.

Compressed air which can be taken from the compressed air system is conveniently used to generate the lubricating agent mist. It will, however, also be possible to use the exhaust air of the pneumatic cylinders that orginates on the lowering of mangle cylinders 9 into the mangle troughs 15. Herein, the amount of measured lubricating agent mist which is supplied by the atomizer 2 to pipe 7 is apportioned in such a way that it is substantially smaller than the amount of air suctioned away from the individual mangle cylinders. The ratio between the suctioned off output of a non-illustrated suctioning ventilator that acts on mangle cylinder 9 and the lubricating agent mist from pipe 7 that strikes mangle cylinder 9 is greater than 10:1.

Since application of the lubricating agent mist is required only at certain time intervals and needs to be measured, the apparatus of the present invention can be controlled to operate on a time-wise basis, for instance shortly before placing laundry pieces to be dried and smoothed into the steam trough mangle on a lowering of the mangle cylinders 9 into mangle troughs 15.

Should an improvement in sliding quality become necessary while the trough is operated, then corresponding action is taken at a time when no laundry pieces pass through the mangle.

In the aforementioned embodiment, the solution proposed by this invention was explained in connection with a two-trough mangle, in which pipe 7 has the openings 8 directed to both mangle cylinders 9. It is also possible—without deviating from the spirit of the invention—to use this apparatus in a single trough mangle. Herein, pipe 7 is preferably arranged at the mangle entrance, having only one row of openings 8 in pipe 7 directed onto mangle cylinder 9. In four-mangle troughs, pipes 7 are arranged between the first and second and between the third and the fourth mangle cylinders. Herein, preferably only one atomizer 2 and one supply vessel 1 are arranged at a central point of the four-trough mangle. Within the supply conduit 6, namely in the region between the atomizer 2 and the arc 6*a*, a branching has been arranged so that lubricating agent mist can be supplied to each pipe 7. Preferably, a blocking mechanism 5, the actuation of which can be controlled, is arranged at a central point in each supply conduit 6 leading to the pipe 7. It may, however, also be possible to arrange an atomizer 2 in front of each pipe 7.

Compressed air was stated in the above described embodiment as the gaseous medium transporting the lubricating agent. It may, however, also be possible to use other gaseous mediums, such as, for instance, steam.

The number, position, and size of the openings 8 within a row of openings within pipe 7 depend on the pressure conditions inside pipe 7. Herein, openings 8 are arranged in such a way that the lubricating agent mist exiting from openings 8 will, for the most part, strike on mangle cylinders 9 in the region of the pressing surfaces 13, 15.

I claim:

1. In a steam trough mangle comprising at least one mangle unit including a mangle cylinder having a wrapping and at lease one steam trough partly surrounding said cylinder forming a pressing surface, an apparatus for decreasing the friction between the pressing surface and laundry while being ironed and dried by means of said mangle, said apparatus comprising (A) an atomizer for atomizing a liquid lubricating agent by means of a gaseous medium under pressure, (B) at least one conduit connected with said atomizer for conducting atomized lubricating agent mist away from said atomizer (A), and (C) at least one pipe connected with said conduit (B), said pipe being provided with openings and extending substantially over the entire width of said at least one mangle unit for spraying said lubricating agent through said openings onto said pressing surface and the wrapping thereby to decrease friction between the laundry and the pressing surface during drying and ironing of the laundry.

2. The apparatus of claim 1 additionally comprising (D) at least one supply vessel containing liquid lubricating agent, and (E) a conduit connecting said supply vessel (D) with said atomizer (A) to supply liquid lubricating agent to be atomized to said atomizer (A).

3. An apparatus according to claim 1, further comprising means for guiding said laundry in contact with substantially 180° of said mangle trough cylinder.

4. An apparatus for applying a liquid lubricating agent onto a machine for ironing and drying laundry thereby to decrease friction between said machine and said laundry when said laundry passes through said machine, comprising (A) an atomizer for atomizing a liquid lubricating agent by means of a gaseous medium under pressure, (B) at least one conduit having an apex and connected with said atomizer for conducting atomized lubricating agent mist away from said atomizer (A), (C) at least one pipe connected with said conduit (B), said pipe being provided with openings and upwardly inclinded downstream of said conduit (B), the downstream end of the upwardly inclined pipe being vertically lower than the apex, said pipe extending substantially over the entire width of said machine for conducting atomized lubricating agent through said openings to spread onto said machine, said openings in the pipe being situated above a lowest point of an internal cross-section of the pipe to collect condensed lubricating agent along said lowest point thereof, said lowest point of the internal cross-section of the pipe forming a channel for directing condensed lubricating agent back down said inclined pipe, (D) at least one supply vessel containing liquid lubricating agent, (E) a conduit connecting said supply vessel (D) with said atomizer (A) for conducting liquid lubricating agent to said atomizer (A), and (F) a conduit connecting said supply vessel (D) with said conduit (B) at a point between the apex of said conduit (B) and said pipe (C).

5. The apparatus of claim 4 in which the openings in said pipe (C) are formed as nozzles.

6. The apparatus of claim 4 in which the openings in said pipe (C) are formed as borings.

7. The apparatus of claim 4 in which the openings in said pipe (C) are formed as slots.

8. The apparatus of claim 4 in which the number, position, and size of the openings in the pipe (C) depend on pressure conditions inside the pipe (C).

9. The apparatus of claim 4 additionally comprising (G) a valve situated in said conduit (F).

10. The apparatus of claim 9 additionally comprising (H) a conduit connected with said atomizer (A) for supplying gaseous medium to said atomizer (A) for atomizing said liquid lubricating agent, and (I) a valve situated in said conduit (H).

11. The apparatus of claim 10 in which said valves (G) and (I) are both time-controlled, and are alternately openable and closeable with respect to one another.

12. The apparatus of claim 11 in which said pipe (C) is centrally positioned with respect to the surface for ironing and drying laundry.

13. The apparatus of claim 12 in which said valves (G) and (I) may be opened when there is no laundry on the surface for ironing and drying laundry.

14. The apparatus of claim 13 in which the gaseous medium supplied to the atomizer (A) through conduit (H) is compressed air.

15. The apparatus of claim 14 additionally comprising (J) at least one mangle cylinder and corresponding trough which include the surface for ironing and drying laundry, in which the compressed air is exhaust air from raising and lowering the mangle cylinder (J).

16. The apparatus of claim 15 in which the quantity of the gaseous medium exiting from the openings in pipe (C), including the lubricating agent, is smaller than the amount of exhaust air suctioned from mangle cylinder (J).

17. The apparatus of claim 15 in which pipe (C) is arranged in direct proximity to the ironing and drying surface of said mangle cylinder and said trough (J).

18. The apparatus of claim 16 in which the openings in pipe (C) are situated to predominantly direct lubricating agent onto the area of the ironing and drying surface.

19. The apparatus of claim 13 in which the gaseous medium supplied to the atomizer (A) through conduit (B) is steam.

* * * * *